US010559912B2

(12) United States Patent
Eberlein et al.

(10) Patent No.: US 10,559,912 B2
(45) Date of Patent: Feb. 11, 2020

(54) METHOD FOR PRODUCING AND ELECTRICAL ASSEMBLY

(71) Applicant: Brose Fahrzeugteile GmbH & Co. Kommanditgesellschaft, Bamberg, Bamberg (DE)

(72) Inventors: Steve Eberlein, Hallstadt (DE); Holger Schmitt, Adelsdorf (DE)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 0 days.

(21) Appl. No.: 16/162,851

(22) Filed: Oct. 17, 2018

(65) Prior Publication Data

US 2019/0115683 A1 Apr. 18, 2019

(30) Foreign Application Priority Data

Oct. 17, 2017 (DE) ..... 10 2017 218 541

(51) Int. Cl.
*H01R 43/02* (2006.01)
*H01R 13/516* (2006.01)

(52) U.S. Cl.
CPC ..... *H01R 13/516* (2013.01); *H01R 43/02* (2013.01); *H01R 43/0256* (2013.01); *H01R 43/0263* (2013.01)

(58) Field of Classification Search
CPC ..... H01R 13/516; H01R 43/0263; H01R 43/0256; H01R 43/02
See application file for complete search history.

(56) References Cited

U.S. PATENT DOCUMENTS 5,490,786 A * 2/1996 Mosquera ..... H01R 12/57 439/79
5,897,384 A * 4/1999 Hosler, Sr. ..... H01R 24/50 439/581
5,944,536 A * 8/1999 Seong ..... H01R 43/0256 439/79
6,514,103 B2 2/2003 Pape et al.
9,520,666 B2 12/2016 Hagemeier et al.
2002/0076952 A1* 6/2002 Roy ..... H01L 23/49811 439/65

(Continued)

FOREIGN PATENT DOCUMENTS

EP 1160922 A2 12/2001
WO WO2014127999 A1 8/2014

*Primary Examiner* — Truc T Nguyen
(74) *Attorney, Agent, or Firm* — Muncy, Geissler, Olds & Lowe, P.C.

(57) ABSTRACT

A method for producing an electrical assembly, in particular of a motor vehicle. A base body is provided and an electrical connector is provided. The electrical connector is positioned on the base body, wherein a section of the electrical connector is in mechanically direct contact with the base body to form a support surface and a free end of the electrical connector is spaced from the main body, and wherein a center of mass of the electrical connector is laterally offset with respect to a first spatial region located vertically above the support surface. The electrical connector is stabilized by a holder, and the electrical connector is attached to the base body by SMD soldering. An electrical assembly is also provided.

9 Claims, 3 Drawing Sheets

(56) References Cited

U.S. PATENT DOCUMENTS

| | | | | |
|---|---|---|---|---|
| 2004/0140123 | A1* | 7/2004 | Birgel | H01R 9/16 174/261 |
| 2012/0097441 | A1* | 4/2012 | Zhou | H01R 4/027 174/260 |
| 2015/0083478 | A1* | 3/2015 | Endo | H01R 12/707 174/261 |

* cited by examiner

METHOD FOR PRODUCING AND ELECTRICAL ASSEMBLY

This nonprovisional application claims priority under 35 U.S.C. § 119(a) to German Patent Application No. DE 10 2017 218 541.4, which was filed in Germany on Oct. 17, 2017, and which is herein incorporated by reference.

BACKGROUND OF THE INVENTION

Field of the Invention

The present invention relates to a method for producing an electrical assembly and to an electrical assembly. The electrical assembly can be a component of a motor vehicle.

Description of the Background Art

Motor vehicles usually have a number of electrical assemblies by means of which functions of the motor vehicle are influenced. Thus, for example, energization of an electric motor, which in particular drives an adjusting part, is adjusted by means of such an electrical assembly. The electrical assembly usually has a printed circuit board, to which a number of electrical and/or electronic components are attached, which are electrically contacted with one another by means of traces of the circuit board. The electrical or electronic components are electrically contacted with one another according to a specific circuit arrangement.

The electrical or electronic components are attached to the circuit board, for example, by means of through-hole mounting ("through hole technology"). In this case, each of the electrical or electronic components has a number of so-called pins which are inserted through contact holes of the circuit board. The pin end extending through the circuit board is attached by means of solder to the rear side of the circuit board. An alternative to this is the connection of the electrical or electronic components by means of surface mounting ("surface mount technology"). Here, for example, the so-called reflow method is used. In this case, the solder is first applied to the circuit board. In the next step, the circuit board is populated with the electrical or electronic components. For this purpose, for example, an adhesive is used or the solder is formed such that the components adhere to it. In a further step, the circuit board is heated such that the solder melts and the components are thus soldered to the circuit board. In a further step, the circuit board is cooled with the components attached thereto.

During operation, the energization of the electrical or electronic components of the electrical assembly is usually carried out by means of electrical connectors, which are made, for example, as stamped/bent parts. These are usually connected to the circuit board by through-hole mounting. In this case, the electrical connector is stabilized by the contact holes of the circuit board, so that relatively long electrical connectors can be used, which thus project beyond the edge of the circuit board. This facilitates subsequent assembly. The disadvantage here, however, is that two different types of solder processes must be used to produce the electrical assembly, which thus increases production time and manufacturing costs.

Alternatively, the electrical connectors have a relatively complicated geometry, so that they can be placed in a relatively stable position on the circuit board. Thus, it is also possible to attach the electrical connectors to the circuit board by SMT soldering, without the electrical connectors moving during production because of the heating of the solder and thus a decreasing adhesive effect. The disadvantage of this is that the geometry of the electrical connector cannot be freely selected.

SUMMARY OF THE INVENTION

It is therefore an object of the present invention to provide a particularly suitable method for producing an electrical assembly and a particularly suitable electrical assembly, wherein in particular manufacturing costs are reduced and/or flexibility is increased.

The method can be used to produce an electrical assembly. By means of the electrical assembly, for example, a circuit is realized by means of which, for example, a function is performed. In particular, functions of a component connected electrically and/or by signals to the electrical assembly can be influenced. The electrical assembly can be a flat assembly. Suitably, the electrical assembly is part of an E-bike or a motor vehicle. During operation of the electrical assembly, a function of an auxiliary unit of the motor vehicle, for example, an adjusting drive, is influenced with particular preference. In particular, the electrical assembly adjusts an electrical current flow or an electrical voltage, which is applied in particular to an electric motor, which is designed brushless, for example. Preferably, a current/voltage control or particularly preferably regulation thereof is realized by means of the electrical assembly. Suitably, an inverter or at least a part of an inverter is realized by means of the electrical assembly. Alternatively, an anti-pinch protection is provided by means of the electrical assembly, in particular if the electrical assembly is a component of a motorized window lift, a motorized seat adjustment, or a motorized door adjustment, such as a side door or a trunk.

The method provides that a base body is provided. Any electrical and/or electronic components are expediently stabilized in the assembled state by means of the base body. In particular, an electrical contacting of any (electrical and/or electronic) components with one another occurs by means of the base body. Furthermore, an electrical connector is provided. In particular, the base body and the electrical connector are provided in one step. In particular, an energization of the individual components of the electrical assembly and/or transmission of data/signals are carried out in the assembled state by means of the electrical connector. The electrical connector is expediently made of an electrically conductive material, in particular a metal. The electrical connector preferably has a region which is designed in the manner of a plug or at least can be contacted with further components in the assembled state. The electrical connector is suitable, in particular provided and set up, for this purpose.

In a further step, the electrical connector is positioned on the base body. In this case, a section of the electrical connector is in mechanically direct contact with the base body. In this case, a support surface is formed, and the connector and the base body are in direct mechanical contact in the area of the support surface. For example, an adhesive or a solder, in particular a solder paste, is present between them. In other words, a mechanically direct contact means that there is no further component other than a material required for forming the connection, such as an adhesive or a solder, between the electrical connector and the base body. Preferably, the section lies flat on the base body. The support surface is expediently parallel to the base body. In particular, the support surface is at least partially formed by means of an electrically conductive region of the base body, such as a connection pad. Furthermore, a free end of the electrical connector is spaced from the base body. The free end forms in particular the region of the electrical assembly that is connected in the assembled state to other components electrically and/or by signals, in particular a cable or another component of a plug. The free end is used in particular for connection to a contact partner by means of positive, non-positive, or material processes such as, e.g., plugging, welding, or soldering.

The electrical connector is positioned on the base body such that a center of mass of the electrical connector is laterally offset with respect to a first spatial area located vertically above the support surface. In other words, the center of mass is outside the first spatial region, which extends in a cylindrical shape perpendicular to the support surface and whose outer boundary is defined by the support surface. Thus, the electrical connector is not positioned torque-free on the base body, and it is necessary to apply a force for holding the electrical connector in this position. Further, the electrical connector is positioned by means of a holder, in particular in the position. Thus, the holder in particular compensates for the torque that acts on the support surface and would pivot it relative to the center of mass of the electrical connector, if the holder were not present.

In a further step, the electrical connector is attached to the base body by SMD soldering. In this case, for example, any further electrical components, such as capacitors, resistors, semiconductor switches, or diodes, and/or any electronic components, such as in particular a microcontroller or an integrated circuit, are attached to the base body. For example, a reflow soldering is used as the SMT soldering. In particular, a solder paste is applied to a component of the subsequent support surface before the positioning of the electrical connector on the base body. In particular, the solder paste is applied to the base body. Subsequently, the electrical connector is then positioned and/or the electrical connector is heated, wherein the solder paste is converted to an at least partially liquid state. In a further step, cooling occurs wherein the solder paste is hardened again. Thus, the base body and the electrical connector are materially connected to one another. In a further alternative, wave soldering is used for the attaching.

Due to the attachment of the electrical connector by SMT soldering (surface mount technology) and thus the realization of the electrical connector as an SMD component (surface mount device), it is possible to attach it in one step to any electrical and/or electronic components on the base body, which reduces manufacturing costs. Due to the holder, it is not necessary for the electrical connector to have a certain geometric shape, which is why flexibility is increased. Thus, there is a non-torque-free connection of the electrical connector to the base body in particular due to the temporally offset center of mass, so that the free end is relatively far away from the support surface. As a result, mounting of the electrical assembly and in particular connection of other components at the free end is facilitated. Expediently, a plurality of such electrical connectors are attached to the base body at the same time and preferably positioned at the same time. The electrical connector has, for example, a heat sink or a positioning aid. Particularly preferably, the electrical connector has a positioning aid. Suitably, the electrical connector has an element for compensating tolerances.

For example, the holder engages an electrical connector region that lies between the free end and the section. Particularly preferably, however, the free end is stabilized by the holder. For example, the free end is grasped by means of the holder. Particularly preferably, however, the free end rests on the holder and is thus stabilized. Suitably, the free-end is substantially loose, which simplifies the process. Due to the grasping of the holder at the free end, a relatively large torque compensation by means of the holder is made possible even at relatively small forces, which is why the electrical connector is held relatively stably by the holder.

For example, the holder is attached to the base body. Thus, the electrical connector is positioned relatively stably even after assembly is completed, so that the robustness of the electrical assembly is increased. Particularly preferably, however, the holder is removed after the SMT soldering. In this case, the position of the electrical connector with respect to the base body is maintained due to the solder used in the SMT soldering, and detachment of the electrical connector from the base body is prevented because of the solder. Due to the removal, it is possible to use the holder in the production of a large number of electrical assemblies, which is why manufacturing costs are reduced. The weight and size of the electrical assembly are also reduced.

For example, the base body is a plastic-coated lead frame. Alternatively, the main body is a molded interconnect device (MID), therefore, in particular an injection-molded plastic component, to which traces are connected, for example, embedded or applied to an outer side. Particularly preferably, a circuit board is used as a base body. The circuit board is, for example, a flexible circuit board. Particularly preferably, however, the circuit board is made rigid or substantially rigid. The circuit board is designed in particular flat. Suitably, the base body comprises a glass-fiber-fabric-reinforced resin, for example, epoxy resin. Due to the use of the circuit board as the base body, it is possible to produce relatively inexpensive electrical assemblies, wherein production time is shortened. The base body expediently comprises a number of traces, which are in particular made of a copper or the like. The traces are preferably connected to a surface of the resin/plastic or embedded in it.

A circuit board composite with the circuit board and an edge is used with particular preference. The circuit board composite is preferably designed in one piece, and the edge is integrally formed on the circuit board. In particular, the edge surrounds the circuit board at least partially. In particular cutouts in the manner of a perforation, which are introduced, for example, by etching or ablation, are arranged between the edge and the circuit board. The circuit board is in particular stabilized by the edge during production and protected against possible damage. It is also possible to use standard components for providing the circuit board composite, wherein the dimensions of the circuit board can be adapted to the individual application. For example, the circuit board composite comprises a number of such circuit boards, for example, between two such circuit boards and twenty such circuit boards, which are each surrounded by the edge. In this case, the circuit board composite preferably has only a single edge. In particular, to complete the production, the circuit board is separated from the circuit board composite, for example, by means of breaking or cutting. Particularly preferably, the edge forms the holder at least partially. In this case, the electrical connector is preferably placed on the holder for stabilization. Thus, the holder is used both for stabilizing the circuit board during production and also for stabilizing the electrical connector, and a relatively small number of components is required, which reduces manufacturing costs. In one alternative, for example, a further circuit board of the circuit board composite forms the holder.

The electrical connector can be designed in one piece. Suitably, the electrical connector is made of a metal, for example, by punching. Particularly preferably, the electrical connector is a stamped/bent part made of sheet metal. Manufacturing costs are reduced in this way, and it is possible to use many different geometries for the electrical connector.

The electrical connector can be positioned on the base body such that the center of mass of the electrical connector is located outside a second spatial region located vertically above the base body, therefore, offset out of the spatial region. The second spatial region comprises the first spatial region. In other words, the center of mass expediently lies outside a second spatial region which extends perpendicular to the main body, in particular is cylindrical in design, and whose outer boundary is defined by the base body. For example, the center of mass is outside the possible circuit board area. Consequently, the electrical connector projects relatively far beyond the base body, so that the assembling of the electrical assembly is facilitated.

For example, the electrical connector has a plurality of sections which are in direct mechanical contact with the base body and which are spaced apart from one another. Thus, a plurality of support surfaces are formed. As a result, the electrical connector is stabilized by means of the plurality of sections, so that force applied to the holder is reduced. Particularly preferably, however, the electrical connector is positioned on the base body such that only a single contact area is formed between the connector and the base body. The contact area is in particular the support surface. As a result, only a relatively small area of the base body is covered by the electrical connector, so that space for possible electrical and/or electronic components is increased. Therefore, the size of the electrical assembly is reduced. Due to the holder even with only the single contact area there is a compensation of the resulting torque, which would lead to a pivoting of the electrical connector in the absence of the holder, and after the SMT soldering, the electrical connector is stabilized due to the soldering process.

For example, the electrical connector can be made flat and in particular has a substantially parallel arrangement with respect to the base body. As a result, the space required is reduced and manufacturing is simplified. Alternatively, the electrical connector is bent and in particular has a substantially three-dimensional course. Particularly preferably, however, the electrical connector is bent after the SMT soldering. In other words, the electrical connector is attached to the base body, in particular in a flat state, and bent after the SMT soldering such that it has a three-dimensional course. Thus, stabilization is simplified by the holder, wherein the electrical connector can be adapted to any mounting positions, which is why mounting is simplified.

The electrical assembly expediently can have a circuit which is provided and set up in particular to carry out and/or to influence a specific function. In particular, the electrical assembly is a flat assembly. Preferably, the electrical assembly is a component of a motor vehicle and a function of the motor vehicle, in particular of an auxiliary unit of the motor vehicle, is influenced by the electrical assembly. The electrical assembly comprises a base body, for example, a circuit board, and an electrical connector, which is attached to the base body by SMT soldering. The electrical connector extends over the base body at the edge. In particular, a free end of the electrical connector projects beyond the base body at the edge. In other words, the free end is located outside a second spatial area, which is located vertically above the main body. Further in other words, the free end projects over the base body. Due to the projection, connection to the electrical connector is simplified. Production is also simplified in addition because of the connection to the base body by SMT soldering. Expediently, the electrical assembly has a plurality of such electrical connectors, which are mounted in particular substantially at the same time.

Suitably, the electrical connector can be attached to a possible connection pad of the base body, which is preferably electrically contacted by possible traces or at least one trace of the base body. Particularly preferably, the electrical assembly is produced according to a method in which the base body and the electrical connector are provided. The electrical connector is positioned on the base body in a further step such that a section of the electrical connector with the formation of a support surface is in mechanically direct contact with the base body and a free end of the electrical connector is spaced from the base body. In this case, a center of mass of the electrical connector is laterally offset with respect to a first spatial area located vertically above the support surface. In this state, the electrical connector is stabilized by a holder. Further, the electrical connector is attached to the base body by SMT soldering. Particularly preferably, the holder is removed after the SMT soldering.

Suitably, the center of mass of the electrical connector can be located outside an edge boundary of the base body. In particular, the center of mass is thus outside of a second spatial region located vertically above the base body. In other words, the center of mass is located outside a circuit board surface or a second spatial region located above it. As a result, a relatively large proportion of the electrical connector is located outside the edge boundary of the base body, which simplifies the assembly of the electrical assembly.

The refinements and advantages explained in connection with the method for producing an electrical assembly are also to be applied analogously to the electrical assembly and vice versa.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
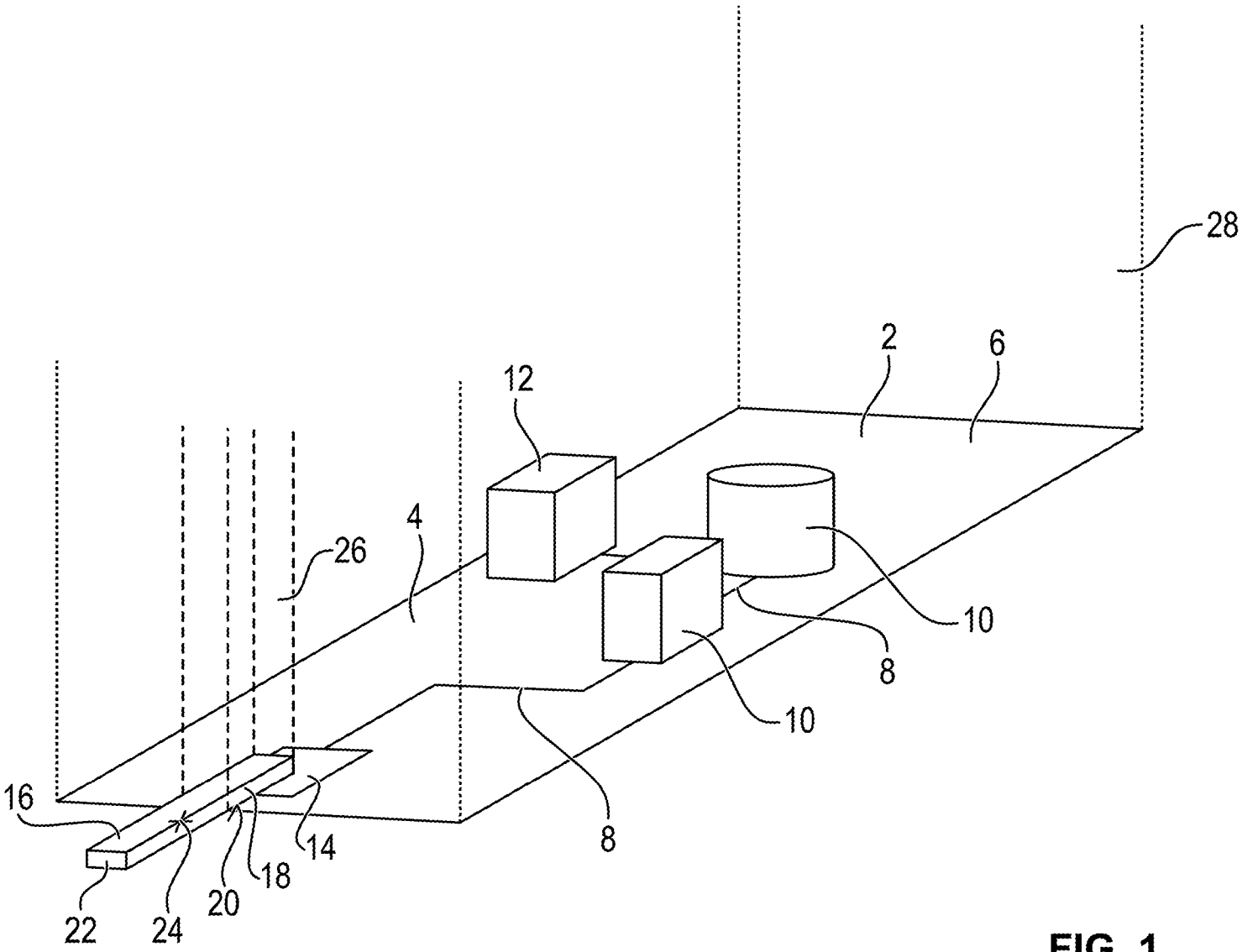
FIG. 1 shows in a perspective, schematic, and simplified manner an electrical assembly of a motor vehicle.

An electrical assembly 2 having an electrical circuit is shown schematically simplified in a perspective illustration in FIG. 1. In this case, the energization of an electric motor of a motorized window lift is adjusted by the electric circuit.

The motorized window lift and thus electrical assembly 2 are part of a motor vehicle. Electrical assembly 2 has a base body 4 in the form of a circuit board, which has a flat piece 6. Flat piece 6 is a glass-fiber-reinforced epoxy resin and is made substantially flat. Flat piece 6 in this case has a substantially rectangular shape, wherein a thickness of flat piece 6 is, for example, 1 mm and is at least 10 times smaller than the extent in the other spatial directions.

A number of traces 8, which are made of a copper, are connected to one of the surfaces of flat piece 6. A number of electrical components 10 in the form of capacitors and resistors and an electronic component 12 in the form of an integrated circuit are electrically contacted to traces 8 and secured there by means of solder. The electrical and/or electronic components 10, 12 are surface-mount devices (SMD). Further, base body 4 has a connection pad 14, which is provided by means of a widening of a free end of one of traces 8.

Further, electrical assembly 2 comprises an electrical connector 16 in the form of a stamped/bent part. Electrical connector 16 has a section 18 which is in mechanically direct contact with base body 4 with the formation of a support surface 20 located therebetween. Support surface 20 is at least partially provided by a section of connection pad 14, to which electrical connector 16 is connected by SMT soldering. The rectangular electrical connector 16 further has a free end 22, which is spaced from base body 4 and thus extends beyond base body 4 at the edge. In this case, a center of mass 24 of electrical connector 16 is offset from section 18 toward free end 22 and is thus laterally offset relative to a first spatial region 26 located vertically above support surface 20, namely in the direction of free end 22. In addition, because electrical connector 16 extends beyond base body 4, center of mass 24 is moreover located outside a second spatial region 28 that is located vertically above base body 4. In other words, center of mass 24 of electrical connector 16 is located outside an edge boundary of base body 4.

Electrical assembly 2 has a plurality of such electrical connectors 16, of which only one is shown by way of example. In this case, a connection pad 14 is assigned to each electrical connector 16. Energization of the electrical and/or electronic components 10, 12 occurs by means of electrical connectors 16. Data are also exchanged between these components 10, 12, which form the electrical circuit, and other components of the motor vehicle.

Figure 2:
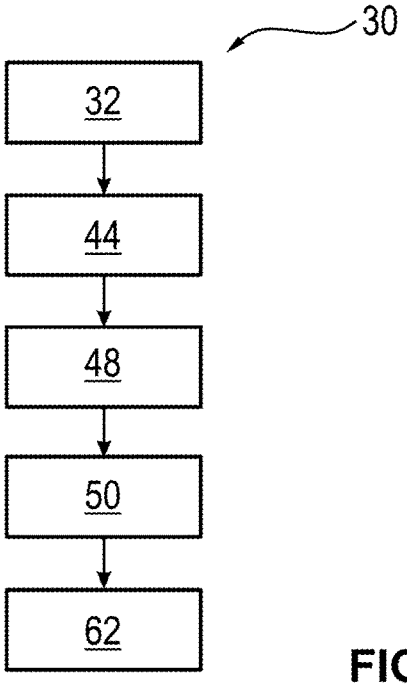
FIG. 2 shows a method for producing the electrical assembly.
Figure 3:
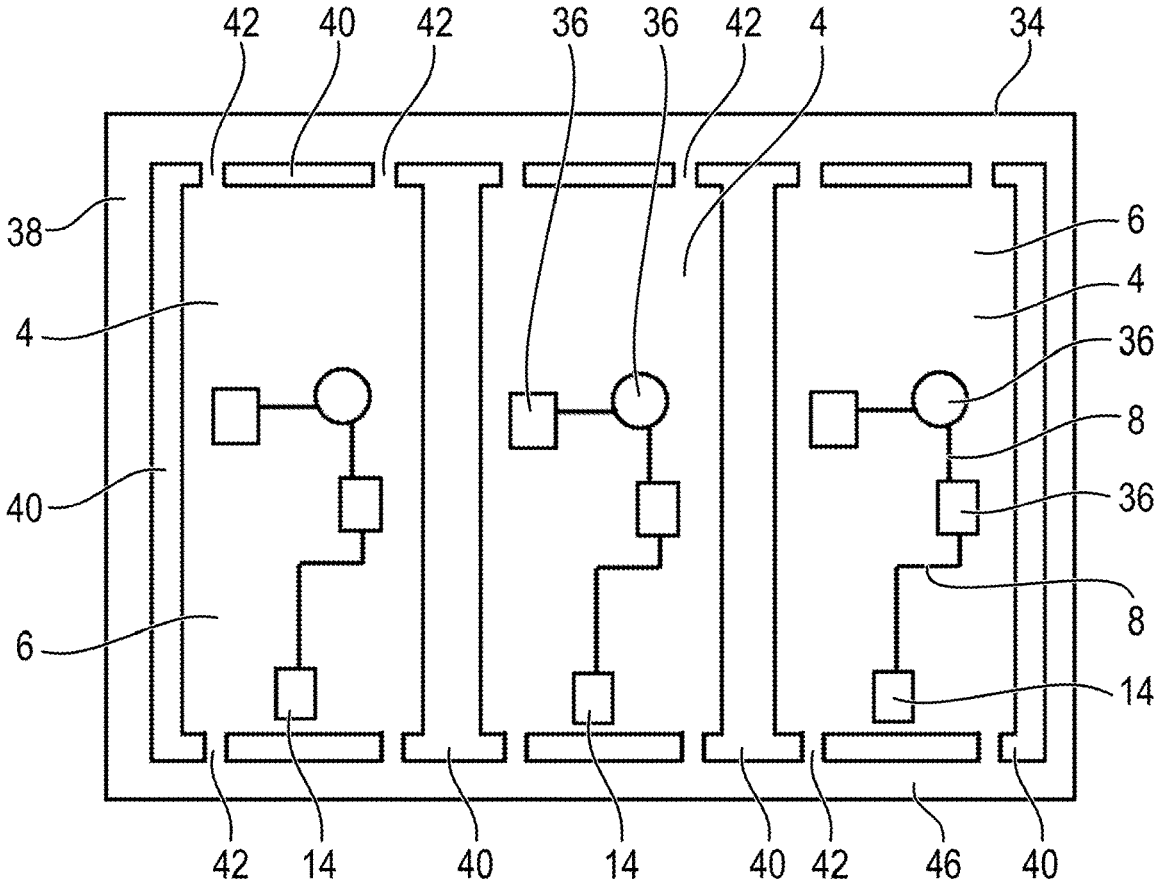
FIG. 3 shows in a top plan view a circuit board composite with a plurality of circuit boards and an edge.

A method 30 for producing electrical assembly 2 is shown in FIG. 2. In a first step 32, electrical connector 16 is provided. This has been made in a further method or at least one previous step by punching from a metal sheet. In addition, base body 4 is provided in the form of the printed circuit board, wherein circuit board composite 34 shown in FIG. 3 is used. Circuit board composite 34 has three such base bodies 4, which are of similar construction and each of which already has flat piece 6 with traces 8 attached thereto and the respective connection pad 14. In addition, there are mounting locations 36 for the electrical and electronic components 10, 12. Base bodies 4 are arranged parallel to one another in one surface and surrounded by an edge 38. There are cutouts 40, which are created by cutting, between adjacent circuit boards 4 and toward edge 38. Base bodies 4 are each connected by means of four bridges 42 to the edge, so that they are stabilized to each other and to edge 38. Thus, a total of three such electrical assemblies 2 are produced in method 30. To produce circuit board composite 34, a glass-fiber-reinforced epoxy resin coated with copper is provided first, in which the copper is partially removed, so that traces 8 and connection pads 14 and mounting locations 36 are realized. In addition, cutouts 40 are introduced by cutting, so that base bodies 4 connected to edge 38 by bridges 42 are created.

In a subsequent second step 44, mounting locations 36 and in part connection pads 14 are provided with a solder paste and electrical and electronic components 10, 12 are positioned at the respective mounting location 36. Further, the respective electrical connector 16 is positioned on the respectively associated base body 4 such that section 18, with the formation of support surface 20, is in mechanically direct contact with base body 4 by means of the solder paste, wherein free end 22 is spaced from base body 4 and rests on edge 38, which consequently acts as a holder 46. Thus, the respective free end 22 is stabilized by holder 46. Here, center of mass 24 of each connector 16 outside the first and second spatial regions 26, 28, therefore, with respect to first spatial region 26 located vertically above the respective support surface 20 and with respect to second spatial region 28, which includes first spatial region 26 and is located vertically above the respective base body 4, is laterally offset, namely in the direction of free end 22. Only a single contact area, namely the single support surface 20, is formed between each electrical connector 16 and the associated base body 4. In other words, there is only one mechanical contact in the area of support surface 20 between electrical connector 16 and the base body.

In a subsequent third step 48, electrical connectors 16 and the electrical and electronic components 10, 12 are attached by SMT soldering, namely a reflow soldering, to the respective base body 4. Here, the solder paste is melted, so that the solder is converted to a liquid state. Tilting of electrical connectors 16 is prevented by holder 46, so that the mechanical contact between electrical connectors 16 and the respective base body 4 is maintained and furthermore the complete support surface 20 is present.

Figure 4:
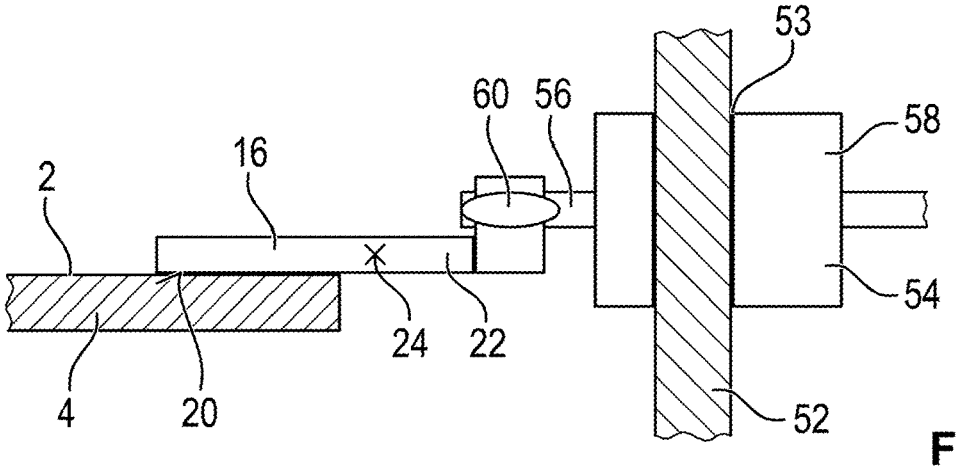
FIGS. 4-6 show in a side and partial view different embodiments of the electrical assembly.

As soon as the solder has hardened again and a material connection between electrical connector 16 and base body 4 and the electrical and electronic components 10, 12 and the respective base body 4 has been established, bridges 42 are separated in a fourth step 50 and thus base body 4 is removed from frame 38. Subsequently, frame 38 functioning as holder 46 is removed. Thus, electrical assembly 2 is completely created and this is installed, for example, in particular in a housing 52, which is shown in a sectional view in FIG. 4. In this case, housing 52 has a through-hole 53, within which a plug 54 is arranged with a contact area 56 which is at least partially surrounded by insulation 58, made of a plastic. Contact area 56 is mechanically and electrically connected to free end 22 by means of a welding point 60. Because of the projection beyond circuit board 4, in this case additional components, such as cable harnesses, can be dispensed with, wherein still a relatively freely selectable position of welding point 60 can be realized.

Figure 5:
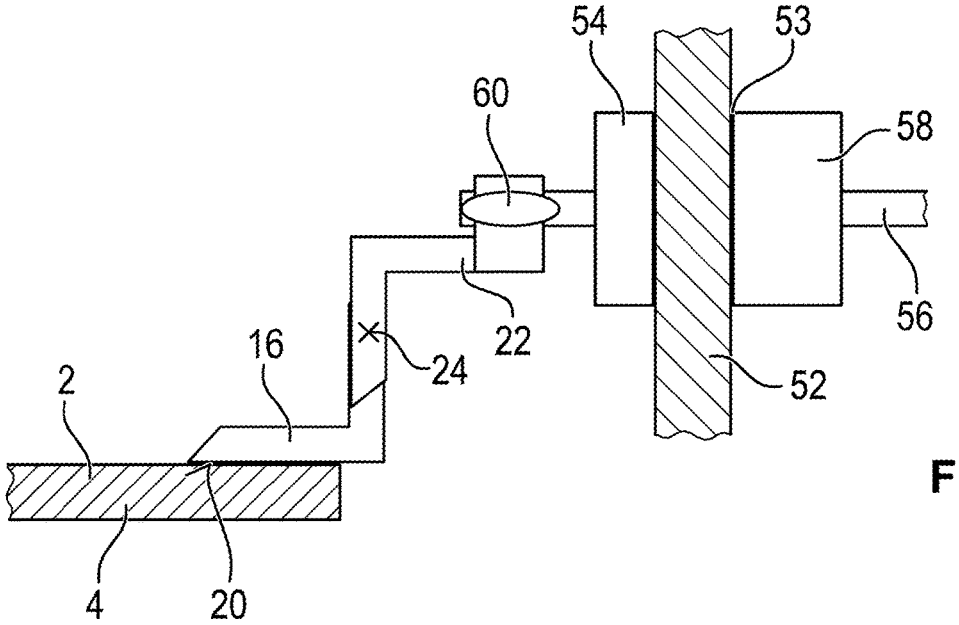
Figure 6:
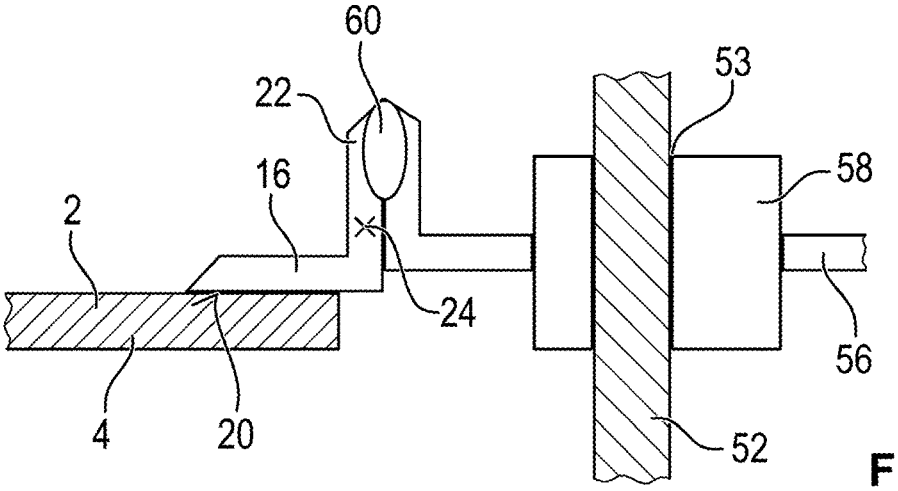

In an alternative, fourth step 50 is followed by a fifth step 62, in which electrical connector 16 is bent, for example, into the S-shape shown in the side view in FIG. 5. Thus, free end 22 is offset perpendicular to the extension plane of base body 4, and base body 4 is offset with respect to welding point 60 and with respect to plug 54 perpendicular to the course of through-hole 53.

In a further alternative, electrical connector 16 is bent into an L-shape, so that the course of free end 22 of electrical connector 16 is perpendicular to the extension plane of base body 4. In this case, contact area 56 within housing 52 is also perpendicular to the course of base body 4 and that of through-hole 53. In other words, contact area 56 is likewise made L-shaped. As a result, it is possible to create welding spot 60 by means of a welding gun.

In summary, electrical connector 16 is an SMD-mountable stamped/bent part which extends beyond the edge of the circuit board, therefore, base body 4. Therefore, flexible connection positions can be selected. The resulting unstable center of gravity, therefore, center of mass 24, which can lead to a tipping over of electrical connector 16 during the SMT assembly, is counterbalanced in that electrical connector 16 is fully or partially placed on holder 46 before the SMT soldering, said holder which lies outside the edge of circuit board 4 and is provided by edge 38 or another circuit board 4. Thus, electrical connector 16 is stabilized. For example, electrical connector 16 has a heat sink, in particular for a subsequent welding process, or additional positioning aids. Alternatively or in combination with this, electrical connector 16 has an element for compensating for tolerances, in particular a spring element.

For example, electrical connector 16 extends only beyond the edge of circuit board 4, which simplifies a connection to plug 54. Alternatively, electrical connector 16 is bent after SMT soldering to realize alternative connection positions with plug 54. Consequently, it is possible to flexibly choose the position of welding point 60, so that different installation spaces and heights can be used. Also, in the case of production and packaging, electrical connector 16 does not limit the height during SMT soldering. Further, it is possible to position free end 22 substantially freely, so that accessibility and robustness for subsequent processes are increased, such as in particular welding to plug 54, for example, resistance welding. Due to the moving of free end 22 away from the edge of base body 4, therefore, the circuit board, the connection process, therefore, the creation of welding point 60, does not occur via the SMT assembly, therefore, electrical assembly 2, which reduces the risk of, e.g., contamination by possible welding spatter. It is also possible to use standard welding tools, because the position of free end 22 can be adjusted thereto.

Due to the connection of electrical connector 16 by SMT technology, it is possible to attach it to base body 4 in one step with the connection of the electrical and electronic components 10, 12, which results in a reduction of cost, in particular investment and process costs. Also, no plastic collar is required for fixing electrical connector 16.

In summary, the area between plug 56 and base body 4 is bridged by electrical connector 16 and it is possible to weld these directly. For production, electrical connector 16 is supported on edge 38, which thus acts as a holder 56. Consequently, it is possible to achieve flexible connection positions with electrical connector 16 designed as a SMT-mountable part. Electrical connector 16 is bent, for example, after the SMT soldering, so that in particular a height difference between plug 56 and electrical assembly 2 is bridged. Accessibility for subsequent processes is also facilitated/made possible. Thus, it is possible that free end 22 extends into a tool-accessible area and can be welded there to plug 56. Therefore, for example, a welding gun can be used, which is introduced from above electrical assembly 2 into housing 52, which is designed, for example, cup-shaped. In this case, free end 22 expediently extends in the direction of the opening.

The invention is not limited to the exemplary embodiments described above. Rather, other variants of the invention can also be derived herefrom by the skilled artisan, without going beyond the subject of the invention. Particularly, further all individual features described in relation to the individual exemplary embodiments can also be combined with one another in a different manner, without going beyond the subject of the invention.

What is claimed is:

1. A method for producing an electrical assembly of a motor vehicle, the method comprising:

providing a base body;

providing an electrical connector;

positioning the electrical connector on the base body, wherein a section of the electrical connector is in mechanically direct contact with the base body to form a support surface, wherein a free end of the electrical connector is spaced from the main body, and wherein a center of mass of the electrical connector is laterally offset with respect to a first spatial region located vertically above the support surface;

stabilizing the electrical connector by a holder; and attaching the electrical connector to the base body via surface mount technology (SMT) soldering, wherein a circuit board is used as the base body, and wherein a circuit board composite that includes the circuit board and an edge is used, wherein the edge forms the holder at least partially.

2. The method according to claim 1, wherein the free end is stabilized by the holder.

3. A method for producing an electrical assembly of a motor vehicle, the method comprising:

providing a base body;

providing an electrical connector;

positioning the electrical connector on the base body, wherein a section of the electrical connector is in mechanically direct contact with the base body to form a support surface, wherein a free end of the electrical connector is spaced from the main body, and wherein a center of mass of the electrical connector is laterally offset with respect to a first spatial region located vertically above the support surface;

stabilizing the electrical connector by a holder; and attaching the electrical connector to the base body via surface mount technology (SMT) soldering, wherein the holder is removed after the SMT soldering.

4. The method according to claim 1, wherein a stamped and/or bent part is used as the electrical connector.

5. The method according to claim 1, wherein the electrical connector is positioned on the base body such that the center of mass of the electrical connector is located outside a second spatial region located vertically above the base body.

6. The method according to claim 1, wherein the electrical connector is positioned on the base body such that only a single contact area is formed between the electrical connector and the base body.

7. An electrical assembly of a motor vehicle, where the electrical assembly is produced according to the method of claim 1, the electrical assembly comprising:

the base body; and the electrical connector attached to the base body by SMT soldering and extending over the base body at an edge boundary, wherein the base body is a circuit board, and wherein the circuit board is part of a circuit board composite that includes the circuit board and an edge, the edge at least partially forming the holder.

8. The electrical assembly according to claim 7, wherein the center of mass of the electrical connector is located outside the edge boundary of the base body.

9. A method for producing an electrical assembly of a motor vehicle, the method comprising:

providing a base body;

providing an electrical connector;

positioning the electrical connector on the base body, wherein a section of the electrical connector is in mechanically direct contact with the base body to form a support surface, wherein a free end of the electrical connector is spaced from the main body, and wherein a center of mass of the electrical connector is laterally offset with respect to a first spatial region located vertically above the support surface;

stabilizing the electrical connector by a holder; and attaching the electrical connector to the base body via surface mount technology (SMT) soldering, wherein the electrical connector is bent after the SMT soldering.

* * * * *